US009074271B2

(12) United States Patent
Teraoka et al.

(10) Patent No.: US 9,074,271 B2
(45) Date of Patent: Jul. 7, 2015

(54) DUAL-PHASE STAINLESS STEEL SHEET AND STEEL STRIP AND METHOD OF PRODUCTION

(75) Inventors: Shinichi Teraoka, Tokyo (JP); Shunji Sakamoto, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 196 days.

(21) Appl. No.: 13/637,690

(22) PCT Filed: Mar. 29, 2011

(86) PCT No.: PCT/JP2011/058483

§ 371 (c)(1),
(2), (4) Date: Sep. 27, 2012

(87) PCT Pub. No.: WO2011/122697

PCT Pub. Date: Oct. 6, 2011

(65) Prior Publication Data

US 2013/0014864 A1 Jan. 17, 2013

(30) Foreign Application Priority Data

Mar. 29, 2010 (JP) ..... 2010-074809
Mar. 8, 2011 (JP) ..... 2011-050003

(51) Int. Cl.
*C22C 38/40* (2006.01)
*C22C 38/42* (2006.01)
(Continued)

(52) U.S. Cl.
CPC ..... *C22C 38/001* (2013.01); *C21D 6/004* (2013.01); *C21D 6/005* (2013.01); *C21D 6/02* (2013.01); *C21D 8/0226* (2013.01); *C21D 8/0236* (2013.01); *C21D 8/0242* (2013.01); *C21D 8/0273* (2013.01); *C21D 9/46* (2013.01); *C21D 2211/005* (2013.01); *C21D 2211/008* (2013.01);
(Continued)

(58) Field of Classification Search
None
See application file for complete search history.

(56) References Cited

U.S. PATENT DOCUMENTS 5,624,504 A 4/1997 Miyakusu et al.
2005/0173031 A1 8/2005 Hasegawa et al.

FOREIGN PATENT DOCUMENTS

JP 63-007338 1/1988
JP 63-169330 7/1988
(Continued)

OTHER PUBLICATIONS

Machine-English translation of Japanese patent 07-138704, Miyakusu Katsuhisa et al., May 30, 1995.*
(Continued)

*Primary Examiner* — Deborah Yee
(74) *Attorney, Agent, or Firm* — Kenyon & Kenyon LLP

(57) ABSTRACT

High strength dual-phase stainless steel sheet and steel strip which are excellent in corrosion resistance, the dual-phase stainless steel sheet and steel strip having a Vicker's hardness of 200HV or more and comprising, by mass %, C: 0.02 to 0.20%, Si: 0.10 to 2.0%, Mn: 0.20 to 2.0%, P: 0.040% or less, S: 0.010% or less, Cr: 15.0 to 18.0%, Ni: 0.5 to 4.0%, Sn: 0.05 to 0.50, N: 0.010 to 0.10%, and a balance of Fe and unavoidable impurities. The dual-phase stainless steel sheet and steel strip have a γp range of 60 to 95, and a ferrite and martensite dual-phase microstructure formed by being heated to the ferrite and austenite dual-phase region, then the austenite phase transforming to martenite in the subsequent cooling process, wherein γp=420C+470N+23Ni+7Mn+9Cu−11.5Cr−11.5Si−12Mo−7Sn−49Ti−47Nb−52Al+189.

12 Claims, 1 Drawing Sheet

(51) Int. Cl.

| | |
|---|---|
| ***C22C 38/54*** | (2006.01) |
| ***C21D 8/00*** | (2006.01) |
| ***C21D 9/00*** | (2006.01) |
| ***C22C 38/00*** | (2006.01) |
| ***C21D 6/00*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/58*** | (2006.01) |
| ***C22C 38/44*** | (2006.01) |
| *C21D 6/02* | (2006.01) |

(52) U.S. Cl.

CPC ..... *C22C 38/008* (2013.01); *C22C 38/02* (2013.01); *C22C 38/04* (2013.01); *C22C 38/40* (2013.01); *C22C 38/54* (2013.01); *C22C 38/58* (2013.01); *C22C 38/42* (2013.01); *C22C 38/44* (2013.01)

(56) References Cited

FOREIGN PATENT DOCUMENTS

| | | |
|---|---|---|
| JP | 07-138704 | 5/1995 |
| JP | 8-319519 | 12/1996 |
| JP | 9-263912 | 10/1997 |
| JP | 2001-288543 | 10/2001 |
| JP | 2002-105601 | 4/2002 |
| JP | 2003-328083 | 11/2003 |
| TW | 200530409 | 9/2005 |

OTHER PUBLICATIONS

Machine-English translation of Japanese patent No. 2002-105601, Hiramatsu Naoto et al., Apr. 10, 2002.*

Machine-English translation of Japanese patent No. 2001-288543, Abe Masayuki et al., Oct. 19, 2001.*

International Search Report dated Jun. 28, 2011, issued in corresponding PCT Application No. PCT/JP2011/058483.

* cited by examiner

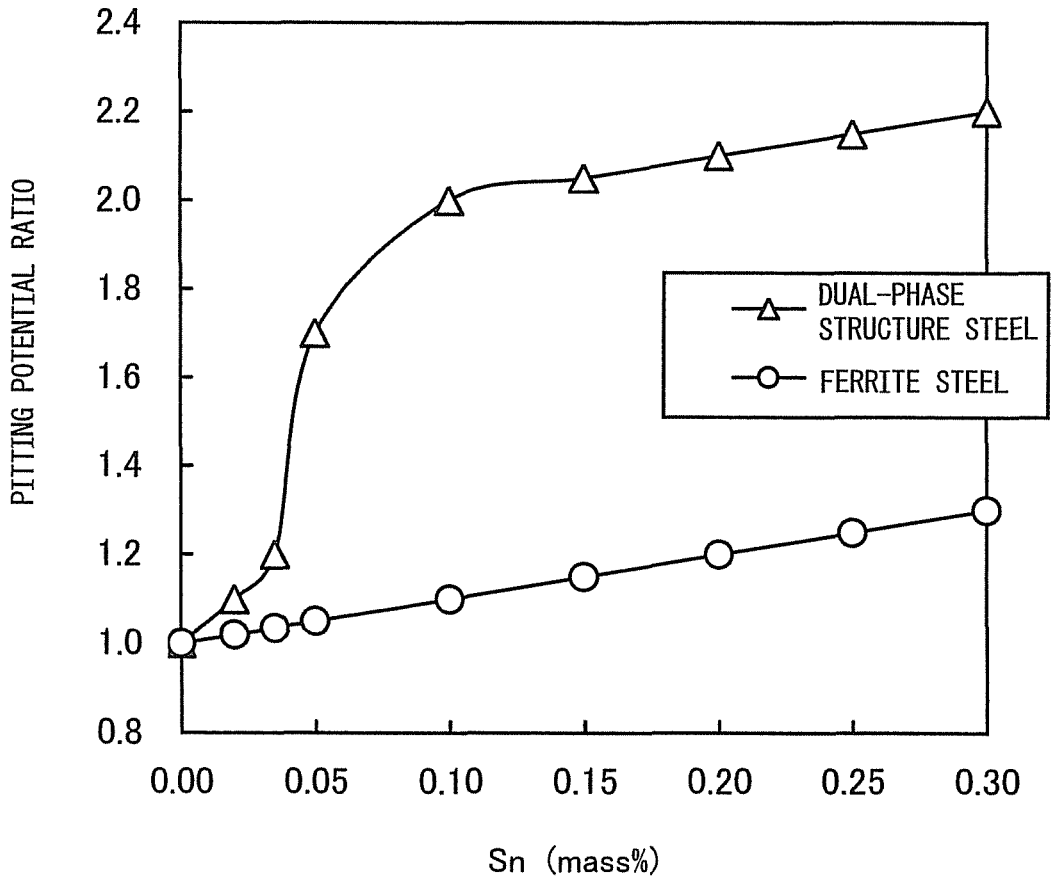
2.4
2.2
2.0
1.8
1.6
1.4
1.2
1.0
0.8
PITTING POTENTIAL RATIO
0.00
0.05
0.10
0.15
0.20
0.25
0.30
Sn (mass%)
DUAL-PHASE STRUCTURE STEEL
FERRITE STEEL

DUAL-PHASE STAINLESS STEEL SHEET AND STEEL STRIP AND METHOD OF PRODUCTION

This application is a national stage application of International Application No. PCT/JP2011/058483, filed Mar. 29, 2011, which claims priority to Japanese Application Nos. 2010-074809, filed Mar. 29, 2010, and 2011-050003, filed Mar. 8, 2011, the contents of which are incorporated by reference in their entirety.

TECHNICAL FIELD

The present invention relates to stainless steel which is excellent in corrosion resistance and abrasion resistance and which has little drop in mirror surface gloss or image reflectability of the surface even with long term use. As specific examples of use, it is provided as the material for various parts such as reflectors of solar light and home lightening equipment, mirrors, machinery, and electrical and electronic equipment.

BACKGROUND ART

As metal materials which are excellent in corrosion resistance and abrasion resistance, martensitic stainless steel, work hardening type austenitic stainless steel, precipitation hardening type and other stainless steel, and ferrite and martensite dual-phase structure stainless steel are known.

Martensitic stainless steel is made a martensite structure by quenching, so can be used while made a high strength. In most cases, it is quenched, then tempered.

The hardness is adjusted by the contents of C and N, the quenching conditions (solution heat treatment temperature, time, and cooling rate), and the tempering conditions (temperature and time).

At the time of martensite transformation, expansion of volume occurs in crystal units, so the steel sheet becomes greater in surface roughness. Martensitic stainless steel is high in strength and low in toughness, so reduction of the surface roughness by temper rolling is not easy.

Further, in the process of making martensitic stainless steel high in strength, the steel is quenched from the austenite single-phase region to obtain a martensite single-phase structure. Cr, Mo, and other elements which improve the corrosion resistance narrow the austenite single-phase formation temperature region, so the amounts of addition are limited.

As one example, in SUS420J1 steel, the amount of Cr is defined as 12 to 14%. For this reason, SUS420J1 steel generally only has the minimum extent of corrosion resistance as stainless steel.

As higher Cr martensitic stainless steel, there are SUS429J1 and SUS431. These contain 15.00 to 17.00% of Cr. If these are made martensite single-phase structures, the ductility becomes low, while if they are made a ferrite or austenite phase and martensite dual-phase structure, the corrosion resistance is impaired.

As a representative type of work hardening type austenitic stainless steel, SUS301 may be mentioned.

SUS301 has an austenite structure at the time of solution treatment. Due to the temper rolling after that, it gradually transforms to the work-induced martensite. Due to the increase in the rolling reduction, the work hardening of the two phases further progresses to make the strength higher.

The composition of SUS301 is 17% Cr–7% Ni. Expensive Ni in 7% is required, so the material cost becomes higher.

Further, the amount of deformation martensite is affected by the material temperature at the time of cold rolling, so in general reverse type rolling in cold rolling of stainless steel, near the coil top and bottom where the rolling speed changes, a change occurs in the amount of deformation martensite and the change in hardness becomes large.

Further, SUS301 is large in work hardening, so when cold rolling hot rolled sheet to finish it to the desired thickness, the rolling load force is high. Depending on the cold rolling speed, annealing process will become necessary and the productivity will otherwise become inferior.

As precipitation hardening type stainless steel, SUS630 (17Cr–4Ni–4Cu), 631 (17Cr–7Ni–1.2Al), and other martensite type precipitation hardened steel are the mainstream.

Martensite type precipitation hardened steel is obtained by solution heat treatment, then cooling to room temperature in the process of which making a martensite structure, then aging so as to cause the formation of precipitated phases rich in Cu and cause fine dispersed precipitation of the intermetallic worked NiAl compound and harden the steel.

Martensite type precipitation hardened steel also requires large amounts of expensive Ni, Cu, and other alloy elements so is high in material cost and is an expensive material.

Furthermore, in the production of martensite type precipitation hardened steel, if precipitation hardened phases are formed at other than the final aging process, the toughness of the material will drop and the cold rolling load will increase resulting in cold rolling becoming no longer possible. For this reason, for example, in the hot rolling process, low temperature coiling is required after hot rolling. Occurrence of defects due to poor coiling shape also becomes a problem.

What has been developed to solve these problems is the dual-phase structure stainless steel which has a dual-phase structure of ferrite and martensite as disclosed in PLT's 1 to 4.

Dual-phase structure stainless steel is obtained by cold rolling hot rolled steel sheet of a ferrite and carbonitride structure, then applying dual-phase annealing which heats this to the ferrite and austenite dual-phase region and cools it so as to transform the austenite phase to martensite and obtain a ferrite and martensite dual-phase structure at room temperature and, furthermore, applying temper rolling and aging.

Dual-phase structure stainless steel is developed based on compositions similar to SUS431 and SUS429J1. The chemical compositions are suitably adjusted to adjust the amount of martensite in accordance with the required hardness.

Dual-phase structure stainless steel reportedly is high in strength and large in ductility, has small in-plane fluctuations in strength, and is excellent in shape flatness as features.

Further, a representative ferritic stainless steel, that is, SUS430 steel, is also reported to easily become a ferrite and martensite dual-phase structure by heating to the dual-phase region and cooling.

However, dual-phase structure stainless steel has a lower amount of Cr in the martensite phase than the ferrite phase, so a difference arises between the phases in the corrosion resistance and the corrosion resistance which is obtained in the average composition cannot be sufficiently obtained or the aging due to corrosion will differ between the phases and thereby unevenness of gloss or hue will occur and the beautiful appearance will be impaired.

CITATIONS LIST

Patent Literature

PLT 1: Japanese Patent Publication No. 63-007338 A1
PLT 2: Japanese Patent Publication No. 63-169330 A1

PLT 3: Japanese Patent Publication No. 07-138704 A1
PLT 4: Japanese Patent Publication No. 2002-105601 A1

SUMMARY OF INVENTION

Technical Problem

There are diverse usages and applications for high strength stainless steel. For cutlery knives, SUS420J1 steel is used, for railroad rolling stock, SUS301 is used, for springs, SUS630, dual-phase structure stainless steel, etc. are used. Materials are being selected based on the corrosion resistance and mechanical properties which are required for the environment.

In recent years, high strength stainless steel which has a higher corrosion resistance than existing stainless steel, has abrasion resistance and high flatness, and is inexpensive in price has become necessary.

In general, as elements which improve the corrosion resistance, Cr, Mo, and N are known. By increasing the contents of these elements, the corrosion resistance is improved, but the phase balance changes, so the targeted high strength can no longer be achieved.

The present invention was made to solve such a problem and has as its object to provide stainless steel which particularly improves the corrosion resistance of the martensite phase, achieves a corrosion resistance corresponding to 18 to 19Cr steel by a 17Cr base, withstands severe outdoor corrosion and abrasive environments, is free from reduction of long term performance as a mirror surface, is inexpensive, and is high in strength.

Solution to Problem

The inventors engaged in various studies on the method of improving the corrosion resistance in stainless steel which is based on 15 to 17Cr steel and has a ferrite and martensite dual-phase structure.

As a result, they discovered that by adding a minute amount of Sn, it is possible to improve the corrosion resistance without causing a drop in the strength.

The reason why Sn acts to improve the corrosion resistance of dual-phase structure stainless steel is believed to be the formation and strengthening of a passivation film in the same way as Cr and Mo.

In general, as elements which improve the pitting resistance of stainless steel in a neutral chloride environment, Cr, Mo, and N are known. As an indicator of pitting resistance, PRE=Cr+3.3Mo+16 to 30N has been proposed. Sn is being used as an element which raises the high temperature strength, but there have been few examples of reports on utilization for the purpose of improving the corrosion resistance.

However, in stainless steel which has a martensite structure, a minute amount of Sn greatly improves the pitting resistance in a neutral chloride environment. This effect is exhibited in martensite steel and dual-phase structure stainless steel which has a ferrite and martensite dual-phase structure.

Dual-phase structure stainless steel which has a ferrite and martensite dual-phase structure differs in amount of Cr at the ferrite phase and the austenite phase at the time of dual-phase forming heat treatment, so usually the corrosion resistance of the martensite phase, which is obtained by transformation of the low Cr austenite phase, becomes lower than the ferrite phase and the corrosion resistance falls to less than the corrosion resistance corresponding to the amount of Cr of the average composition of the base material.

The inventors studied the methods for improving the corrosion resistance of martensitic stainless steel and as a result discovered that the effect of Sn in improving the corrosion resistance is large, in particular, the effect appears under a high dislocation density, that is, when having a high hardness, specifically, when having a hardness of a Vicker's hardness of 200 HV or more.

At the time of dual-phase forming heat treatment, the Sn concentrates at the ferrite phase in the same way as Cr and Mo. However, the martensite phase is improved more in corrosion resistance as an effect by Sn than the ferrite phase. As a result, while the martensite phase has less of an amount of Cr compared with the ferrite phase, the Sn makes up for the difference of Cr and improves the corrosion resistance whereby at least a corrosion resistance corresponding to the amount of Cr of the average composition of the dual-phase structure is obtained.

The present invention was made based on the above discovery and has as its gist the following:

(1) Dual-phase structure stainless steel sheet and steel strip characterized by containing, by mass %,
C: 0.02 to 0.20%,
Si: 0.10 to 1.0%,
Mn: 0.20 to 2.0%,
P: 0.040% or less,
S: 0.010% or less,
Cr: 15.0 to 18.0%,
Ni: 0.5 to 2.5%,
Sn: 0.05 to 0.30, and
N: 0.010 to 0.10%,
having a γp defined by the following formula (a) in the range of 60 to 95, having a balance of Fe and unavoidable impurities,
having a ferrite and martensite dual-phase structure, and
having a Vicker's hardness of 200 HV or more:

$$\gamma p=420C+470N+23Ni+7Mn+9Cu-11.5Cr-11.5Si-12Mo-7Sn-49Ti-47Nb-52Al+189 \quad (a)$$

(2) Dual-phase structure stainless steel sheet and steel strip as set forth in (1) characterized by further containing, by mass %, one or more of
B: 0.0003 to 0.0050%,
Cu: 0.30 to 2.0%,
Mo: 0.30 to 2.0%, and
Al: 0.01 to 0.1%.

(3) A method of production of dual-phase structure stainless steel sheet and steel strip characterized by comprising:
treating cold rolling stainless steel sheet or cold rolled stainless steel strip which has the composition of the above (1) or (2) by
heating it to a ferrite and austenite dual-phase region of 850 to 1100° C. and cooling it for dual-phase forming annealing to thereby cause the austenite phase to transform to martensite and
obtain a ferrite and martensite dual-phase structure at room temperature.

(4) A method of production of dual-phase structure stainless steel sheet and steel strip as set forth in (3) characterized in that the cooling in the dual-phase forming annealing comprises cooling by a cooling speed of 20° C./s or more down to a 550° C. or less temperature.

(5) A method of production of dual-phase structure stainless steel sheet and steel strip as set forth in (3) or (4) characterized by further performing temper rolling and/or aging after the dual-phase forming annealing.

Advantageous Effects of Invention

According to the present invention, it is possible to inexpensively produce high strength dual-phase structure stainless steel which is particularly improved in the corrosion resistance of the martensite phase, achieves a corrosion resistance corresponding to 18 to 19Cr steel based on 17Cr without changing the phase balance, withstands severe outdoor corrosion and abrasive environments, and is free from a drop in the mirror surface gloss over a long term.

BRIEF DESCRIPTION OF DRAWINGS

FIG. 1 is a view which shows the effect of addition of Sn on the corrosion resistance in ferrite structure stainless steel and dual-phase structure stainless steel.

DESCRIPTION OF EMBODIMENTS

Below, the chemical composition of the dual-phase structure stainless steel sheet and steel strip of the present invention will be explained. Below, "%" shall mean "mass %".

C: 0.02 to 0.20%

C is an austenite stabilizing element and is particularly effective for strengthening the martensite by solid solution hardening. The undissolved carbides at the time of solution treatment have the effects of strengthening the martensite and raising the abrasion resistance. These effects become remarkable when the content of C becomes 0.02% or more.

However, along with the increase of the content of C, in the cooling process after the dual-phase forming annealing, Cr carbides precipitate and form Cr poor phases and thereby lower the corrosion resistance, so the so-called sensitization phenomenon easily occurs. Therefore, the content of C is made 0.20% or less. The preferable content of C is 0.10 to 0.15%.

Si: 0.10 to 1.0%

Si is a ferrite stabilizing element. It is large in solid solution hardening ability and causes the ferrite and martensite phases to harden. Further, in the steelmaking process, it also acts as a deoxidizing element. This action appears conspicuously when the content of Si is 0.10% or more. However, if the content of Si is over 1.0%, the phase balance suitable for dual-phase structure stainless steel can no longer be maintained. The preferable content of Si is 0.20 to 0.70%.

Mn: 0.20 to 2.0%

Mn is an austenite stabilizing element and is an alloy element which is required for obtaining a more suitable phase balance of austenite and ferrite at the time of dual-phase forming annealing, so is included in 0.20% or more.

The austenite stabilizing ability of Mn is about half that of Ni, but this is an element which is cheaper than Ni. On the other hand, the effect of lowering the Ms point is greater than Ni. Residual γ is formed and the hardness falls. Further, Mn is an element which obstructs oxidation resistance. The surface quality sometimes falls due to the oxidation at the time of annealing. Accordingly, as a range with little effect in impairing quality, the content of Mn is made 2.0% or less. The preferable content of Mn is 0.50 to 1.0%.

P: 0.040% or less

P is an element with a large solid solution hardening ability, but is a ferrite stabilizing element. Further, it is an element which is harmful to the corrosion resistance and toughness. The ferrochrome material of stainless steel contains this as an impurity, but there is no technique for removing P from a melt of stainless steel, so the purity and amount of the ferrochrome material used determines the amount of P. However, low P ferrochrome is expensive, so as the range not greatly degrading the material quality or corrosion resistance, the content of P is made 0.040% or less. The preferable content of P is 0.030% or less.

S: 0.010% or less

S forms sulfide inclusions and degrades the usual corrosion resistance of steel materials (general corrosion resistance and pitting resistance), so the content has to be made 0.010% or less. The smaller the content of S, the better the corrosion resistance, but reducing S increases the desulfurization load, so the lower limit is preferably made 0.003%. The preferable content of S is 0.003 to 0.008%.

Cr: 15.0 to 18.0% or less

Cr is an element which is effective for improving the usual corrosion resistance (general corrosion resistance and pitting resistance), but if the content is less than 15%, obtaining a sufficient corrosion resistance is difficult. Cr is a ferrite phase (α-phase) stabilizing element. If the content is over 18%, the stability of the austenite phase (γ-phase) falls and obtaining a high strength by forming a dual-phase structure becomes difficult. The preferable content of Cr is 15.5 to 17.5%.

Ni: 0.5 to 2.5%

Ni is an austenite phase stabilizing element and greatly affects the austenite phase percentage at the time dual-phase forming annealing. To obtain a suitable phase percentage, an amount of Ni corresponding to the amount of Cr is necessary, so the content is made 0.5% or more. Ni is an expensive element. Excessive addition increases the alloy cost, so the content is made 2.5% or less. The preferable content of Ni is 1.0 to 2.0%.

Sn: 0.05 to 0.30%

Sn is a ferrite phase stabilizing element and an element which is effective for improving the corrosion resistance of the martensite phase. Sn concentrates at the ferrite phase at the time of dual-phase forming annealing in the same way as Cr, but in a ferrite and martensite dual-phase structure, improves the corrosion resistance of the martensite phase as if compensating for the difference in the amount of Cr, so a corrosion resistance of at least the level corresponding to the amount of Cr of the average composition of the dual-phase structure is obtained.

To improve the corrosion resistance of the martensite phase, the content of Sn is made 0.05% or more. Even if adding Sn in over 0.30%, the effect of improvement of the corrosion resistance of the martensite phase by the Sn becomes saturated and the alloying cost is needlessly increased, so the content is made 0.30% or less. The preferable content of Sn is 0.1 to 0.25%.

N: 0.010 to 0.10%

N, like C, is an austenite stabilizing element and an element which is effective for strengthening the martensite, so the content is made 0.010% or more. Solute N acts to strengthen the passivation film or improve the corrosion resistance by suppressing sensitization. If excessively adding N, this causes gas porosity type defects, so the content is made 0.10% or less. The preferable content of N is 0.02 to 0.06%.

In addition to the above ingredients, in accordance with need, B, Cu, Mo, and Al may be added.

B: 0.0003 to 0.0050%

B has the effect of preventing edge cracks due to the difference in deformation resistance between the ferrite phase and the austenite phase in the hot rolling temperature region, so the content when added is made 0.0003% or more. If the content of B is over 0.0050%, a drop in corrosion resistance due to precipitation of borides or a drop in the hot workability occurs, so the content is made 0.0050% or less. The preferable content of B is 0.0005 to 0.0030%.

Cu: 0.3 to 2.0%

Cu is an austenite stabilizing element and an alloy element which is effective for obtaining a phase balance of austenite and ferrite at the time of dual-phase forming annealing, so is added in accordance with need. The content in the case of addition is 0.3% or more. The austenite stabilizing ability of Cu is about half that of Ni, but this is an element which is cheaper than Ni.

If excessively adding Cu, a drop in corrosion resistance due to precipitates and uneven gloss of the surface due to the drop in oxidation resistance occur, so the content is made 2.0% or less. The preferable content of Cu is 0.5 to 1.5%.

Mo: 0.3 to 2.0%

Mo is an element which has an effect of improving the corrosion resistance greater than Cr and is added in accordance with need. The content when added is made 0.3% or more. Mo, like Cr, concentrates at the ferrite and the time of dual-phase forming annealing and expands the difference in corrosion resistance between the ferrite and martensite. Further, it is an expensive element and causes a rise in the manufacturing cost, so the content is made 2.0% or less. The preferable content of Mo is 0.5 to 1.2%.

Al: 0.01 to 0.1%

Al is an additional ingredient which is effective as a deoxidizing agent. To obtain the deoxidizing effect, the content is made 0.01% or more. If including Al in a large amount, cluster-shaped high melting point oxides are formed and cause surface defects of the slab. Furthermore, the weldability also becomes poorer, so the content is made 0.1% or less. The preferable content of Al is 0.02 to 0.05%.

In addition, as impurities which are unavoidably contained in stainless steel, there are Nb, Ti, V, Ca, Mg, REM, Co, Y, Zr, etc. These elements enter from the slag in the refining process or the alloy materials and are not deliberately added. The unavoidably contained amounts are 0.01% or less or so. V is greater in unavoidably contained amount than other elements, that is, 0.05% or less.

γp: 60 to 95

The γp which is expressed by the following formula (a) is an indicator which expresses the maximum amount of the austenite phase in the dual-phase region of the ferrite phase and austenite phase of 1000 to 1150° C. and broadly matches the value expressed by the volume percentage % of the austenite phase.

$$\gamma p = 420C + 470N + 23Ni + 7Mn + 9Cu - 11.5Cr - 11.5Si - 12Mo - 7Sn - 49Ti - 47Nb - 52Al + 189 \quad (a)$$

To obtain the amount of martensite which is required for the hardness after dual-phase forming annealing or furthermore after temper rolling or aging to exceed 200 in Vicker's hardness, it is necessary to make the formula of γp 60 to 95.

If γp is less than 60, the ferrite and martensite dual-phase structure will not become a sufficient hardness. Furthermore, if γp is 20 to 60, the hot workability at the time of hot rolling will fall and edge cracks will sometimes occur.

If γp is over 95%, the workability falls.

The characterizing feature of the present invention is the point of addition of Sn to dual-phase structure stainless steel. This effect will be explained below based on experimental findings.

First, as a representative stainless steel of a ferrite single phase structure, a melt basically comprised of SUS430LX steel, while as a representative example of a dual-phase structure, a melt basically comprised of 0.10C−0.5Si−0.35Mn−17.1Cr−1Ni−0.03Nsteel, were smelted in a vacuum melting furnace. These were cast while changing the amount of Sn in the range of 0 to 0.30%.

Next, the steel ingots were ground smooth at their surfaces, then were hot rolled to obtain thickness 3.0 mm hot rolled steel strips.

After this, ordinary methods were used for annealing, pickling, and cold rolling. The SUS430LX based steel was annealed at 880° C., while the 0.10C−0.5Si−0.35Mn−17.1Cr−1Ni−0.03N based steel was heated at 1000° C., then cooled for dual-phase forming annealing.

These materials were used as test materials for measurement of the pitting potential as prescribed in JIS G 0577. FIG. 1 shows the relationship between the amount of addition of Sn and the pitting potential when making the pitting potential of a test material not containing Sn "1" (pitting potential ratio).

The effect of Sn in ferrite single-phase steel and dual-phase structure stainless steel greatly differ. In ferrite single-phase steel, as the amount of addition of Sn increases, the pitting potential increases by a constant ratio, while in dual-phase structure stainless steel, it is learned that the pitting potential rapidly rises from around addition of 0.05% of Sn.

In dual-phase structure steel, the corrosion resistance of the martensite phase is inferior to the ferrite phase, so in the region where the amount of addition of Sn is small, the corrosion resistance is governed by the corrosion resistance of the martensite phase. The martensite phase is improved more in corrosion resistance by the Sn than the ferrite phase, so if the amount of addition of Sn becomes greater, due to the effect of this, it is believed that the pitting potential rapidly rises.

In dual-phase structure stainless steel, the hardness is mainly governed by the amount of martensite, amount of solute carbon and nitrogen, tempering conditions, etc. and corresponds to the dislocation density.

The improvement in the corrosion resistance of the martensite phase due to the addition of Sn appears under a high dislocation density. As an indirect indicator of the corrosion resistance, in the stainless steel of the present invention, the Vicker's hardness is prescribed as being 200 HV or more.

The reason why the improvement of the corrosion resistance by Sn is manifested remarkably under a high dislocation density is not clear, but it is believed to be due to the promotion of strengthening of the passivation film.

To make the Vicker's hardness 200 HV or more, the cooling rate at the time of martensite transformation is preferably made 20° C./s within the range of the composition and γp prescribed by the present invention as explained later.

Next, the preferred method of production of the dual-phase structure stainless steel sheet and steel strip of the present invention will be explained.

First, stainless steel prepared to the above chemical composition is processed by ordinary methods by the steps of hot rolling, annealing of the hot rolled sheet, pickling, and cold rolling to obtain cold rolled stainless steel sheet (hereinafter referred to as "cold rolled steel sheet") or cold rolled stainless steel strip (hereinafter referred to as "cold rolled steel strip").

The heating temperature at the hot rolling is preferably 1140 to 1240° C. so as to secure the hot workability and prevent edge cracks of the end faces of the hot rolled sheet.

Further, the coiling temperature is preferably 600 to 800° C. for softening the hot rolled sheet.

The hot rolled sheet is annealed so as to soften the hot rolled sheet before cold rolling. A box-type annealing furnace is preferably used to perform this under conditions where it is held at 750 to 880° C. for 1 hour to 20 hours.

In the cold rolling which is performed after the pickling, from the viewpoints of productivity and homogenization of the structure, the cold rolling reduction is preferably made 60 to 80%.

After this, the cold rolled steel sheet or cold rolled steel strip is run through a continuous annealing furnace where it is heated to the ferrite and austenite dual-phase region. The heating temperature at this time is Ac1 or more. It has to be a temperature at which the ferrite recrystallizes, so it is made 850° C. or more.

The heating temperature affects the amount of austenite. In the range of Ac1 to 850° C., the amount of austenite greatly changes, so from the viewpoints of uniformity of structure and stability of material quality, 850° C. or more is preferable.

On the other hand, stainless steel which has a ferrite and austenite dual-phase structure is susceptible to creep deformation at a high temperature and easily elongates and is reduced in width in the running direction due to the running tension at the time of continuous heating. Creep deformation occurs more easily the higher the temperature, so the heating temperature is made not more than 1100° C.

If cooling stainless steel which has ferrite and austenite structures which are formed by heating at 850 to 1100° C. for dual-phase forming annealing, in the cooling process, the austenite phase transforms to the martensite phase resulting in a ferrite and martensite dual-phase structure at room temperature.

The critical cooling speed which is required for martensite transformation of dual-phase structure stainless steel is slower than the cooling speed which is required for suppressing sensitization, so the cooling speed is preferably at least the 20° C./s which is required for preventing sensitization. Cooling from the heating temperature to 550° C. or less is preferable.

The steel strip made a ferrite and martensite dual-phase structure was temper rolled and aged in accordance with need.

Temper rolling is aimed at strengthening the ferrite phase compared with the martensite, while the aging is aimed at improving the toughness of the martensite.

The temper rolling rate has to be at least 10% for strengthening the ferrite phase. If cold rolling a dual-phase structure material which already has high strength down to a high rolling reduction, the productivity becomes poor and edge cracks of the width ends sometimes occurs, so the temper rolling rate is preferably 50% or less.

The aging temperature is preferably at least 300° C. where aging becomes possible by continuous annealing. 550° C. or less is preferable from the viewpoint of suppressing sensitization at the time of annealing.

Example 1

The various types of stainless steels of the chemical compositions which are shown in Tables 1 and 2 were smelted in a vacuum melting furnace, heated at 1160° C. for 1 hour, then hot rolled to obtain thickness 3.0 mm hot rolled steel strips which were then placed in a 760° C. coiling reproducing furnace and furnace cooled. The hot rolled strips were annealed at 800° C. for 4 hours, then cooled at 25° C./hr down to 350° C., then air-cooled.

Furthermore, after pickling, cold rolling was used to form thickness 0.5 mm cold rolled steel strips. The cold rolled steel strips were processed by dual-phase forming annealing by a continuous annealing furnace and temper rolling under the conditions which are shown in Tables 3 and 4, then part of the strips were aged.

TABLE 1

| | Steel | C | Si | Mn | P | S | Cr | Ni | Sn | N | B | Cu | Mo | Al | γp |
|---|---|---|---|---|---|---|---|---|---|---|---|---|---|---|---|
| Inv. ex. | A1 | 0.020 | 0.50 | 1.50 | 0.027 | 0.003 | 17.3 | 1.00 | 0.10 | 0.100 | | | | | 72.5 |
| | A2 | 0.150 | 0.50 | 0.35 | 0.027 | 0.008 | 17.0 | 1.00 | 0.10 | 0.030 | | | | | 89.6 |
| | A3 | 0.200 | 0.50 | 0.35 | 0.013 | 0.008 | 18.0 | 0.50 | 0.07 | 0.020 | | | | | 83.1 |
| | A4 | 0.080 | 0.10 | 0.35 | 0.027 | 0.008 | 16.5 | 1.00 | 0.10 | 0.030 | | | | | 70.6 |
| | A5 | 0.090 | 1.00 | 0.35 | 0.027 | 0.007 | 15.2 | 0.80 | 0.05 | 0.030 | | | | | 75.1 |
| | A6 | 0.092 | 0.50 | 0.20 | 0.026 | 0.008 | 15.2 | 1.00 | 0.10 | 0.025 | | | | | 82.5 |
| | A7 | 0.102 | 0.54 | 2.00 | 0.027 | 0.006 | 17.3 | 1.00 | 0.08 | 0.030 | | | | | 77.2 |
| | A8 | 0.078 | 0.50 | 0.35 | 0.040 | 0.008 | 17.3 | 2.00 | 0.10 | 0.030 | | | | | 78.9 |
| | A9 | 0.152 | 0.50 | 0.35 | 0.028 | 0.010 | 17.0 | 1.00 | 0.10 | 0.025 | | | | | 88.1 |
| | A10 | 0.080 | 1.00 | 0.20 | 0.027 | 0.008 | 15.0 | 0.50 | 0.06 | 0.035 | | 0.01 | | | 67.6 |
| | A11 | 0.080 | 0.53 | 0.35 | 0.027 | 0.003 | 16.5 | 1.80 | 0.20 | 0.030 | | | | | 83.3 |
| | A12 | 0.068 | 0.50 | 0.35 | 0.027 | 0.005 | 16.8 | 1.00 | 0.13 | 0.060 | | | 0.02 | | 71.1 |
| | A13 | 0.050 | 0.52 | 0.31 | 0.027 | 0.003 | 17.1 | 2.50 | 0.10 | 0.035 | | | | | 82.8 |
| | A14 | 0.102 | 0.50 | 0.35 | 0.027 | 0.003 | 17.3 | 1.00 | 0.05 | 0.030 | | | | | 66.3 |
| | A15 | 0.130 | 0.51 | 0.35 | 0.027 | 0.004 | 17.3 | 1.00 | 0.30 | 0.030 | | | | | 76.2 |
| | A16 | 0.104 | 0.50 | 0.35 | 0.028 | 0.003 | 17.2 | 1.50 | 0.21 | 0.052 | 0.0003 | | | | 89.1 |
| | A17 | 0.117 | 0.48 | 0.56 | 0.027 | 0.003 | 17.3 | 1.00 | 0.10 | 0.030 | 0.0050 | | | | 74.0 |
| | A18 | 0.085 | 0.50 | 0.35 | 0.027 | 0.009 | 17.3 | 1.80 | 0.08 | 0.010 | | | | | 68.0 |
| | A19 | 0.150 | 0.42 | 0.45 | 0.023 | 0.003 | 17.3 | 1.00 | 0.10 | 0.032 | | 0.30 | | 0.01 | 91.4 |
| | A20 | 0.030 | 0.50 | 2.00 | 0.027 | 0.003 | 16.0 | 0.50 | 0.21 | 0.020 | | 2.00 | | | 63.3 |
| | A21 | 0.095 | 0.48 | 0.45 | 0.028 | 0.010 | 17.3 | 1.00 | 0.18 | 0.060 | | | 0.30 | | 73.9 |
| | A22 | 0.150 | 0.48 | 0.45 | 0.028 | 0.003 | 17.3 | 1.70 | 0.11 | 0.032 | | | 2.00 | | 80.1 |
| | A23 | 0.150 | 0.90 | 0.45 | 0.027 | 0.003 | 17.3 | 1.00 | 0.10 | 0.032 | | | | 0.02 | 83.2 |
| | A29 | 0.150 | 0.50 | 0.45 | 0.027 | 0.003 | 17.6 | 1.00 | 0.21 | 0.032 | | | | 0.10 | 83.6 |
| | A30 | 0.102 | 0.41 | 0.44 | 0.030 | 0.006 | 18.0 | 0.59 | 0.17 | 0.052 | | | | | 60.0 |
| | A31 | 0.147 | 0.56 | 1.10 | 0.027 | 0.003 | 16.3 | 0.70 | 0.10 | 0.032 | | | | | 95.0 |

TABLE 2

| | Steel | C | Si | Mn | P | S | Cr | Ni | Sn | N | B | Cu | Mo | Al | γp |
|---|---|---|---|---|---|---|---|---|---|---|---|---|---|---|---|
| Comp. ex. | a32 | 0.010 | 0.50 | 0.35 | 0.027 | 0.003 | 17.3 | 1.25 | 0.10 | 0.020 | | | | | 28.4 |
| | a33 | 0.210 | 0.50 | 0.35 | 0.027 | 0.008 | 17.2 | 0.80 | 0.00 | 0.030 | | | | | 108.6 |
| | a34 | 0.200 | 1.20 | 0.35 | 0.013 | 0.008 | 18.0 | 0.50 | 0.00 | 0.020 | | | | | 75.6 |
| | a35 | 0.050 | 1.00 | 2.10 | 0.027 | 0.008 | 16.5 | 0.08 | 0.10 | 0.025 | | | | | 36.3 |

TABLE 2-continued

| Steel | C | Si | Mn | P | S | Cr | Ni | Sn | N | B | Cu | Mo | Al | γp |
|---|---|---|---|---|---|---|---|---|---|---|---|---|---|---|
| a36 | 0.152 | 2.00 | 0.35 | 0.042 | 0.007 | 15.1 | 0.08 | 0.05 | 0.030 | | | | | 74.2 |
| a37 | 0.092 | 0.05 | 1.00 | 0.026 | 0.012 | 15.2 | 1.00 | 0.35 | 0.025 | | | | | 91.6 |
| a38 | 0.102 | 0.54 | 2.00 | 0.027 | 0.006 | 14.8 | 0.07 | 0.08 | 0.030 | | | | | 84.6 |
| a39 | 0.020 | 0.50 | 0.18 | 0.040 | 0.008 | 18.2 | 0.00 | 0.00 | 0.030 | | | | | −2.3 |
| a40 | 0.050 | 0.50 | 0.35 | 0.028 | 0.010 | 17.0 | 0.44 | 0.00 | 0.008 | | | | | 25.1 |
| a41 | 0.100 | 0.51 | 0.33 | 0.027 | 0.008 | 17.4 | 2.60 | 0.06 | 0.035 | | | | | 103.2 |
| a42 | 0.080 | 0.53 | 0.35 | 0.027 | 0.003 | 16.5 | 1.80 | 0.04 | 0.030 | | | | | 84.4 |
| a43 | 0.050 | 0.52 | 0.31 | 0.027 | 0.003 | 16.9 | 2.50 | 0.10 | 0.035 | 0.0060 | | | | 85.1 |
| a44 | 0.057 | 0.50 | 0.35 | 0.027 | 0.003 | 17.3 | 1.00 | 0.00 | 0.105 | | | | | 83.0 |
| a45 | 0.063 | 0.51 | 0.35 | 0.027 | 0.004 | 17.3 | 1.00 | 0.00 | 0.030 | | 2.10 | | | 69.1 |
| a46 | 0.060 | 0.50 | 0.35 | 0.028 | 0.003 | 17.1 | 1.50 | 0.00 | 0.052 | | | 2.20 | | 46.8 |
| a47 | 0.151 | 0.80 | 0.68 | 0.027 | 0.003 | 16.8 | 1.17 | 0.00 | 0.032 | | | | 0.12 | 96.7 |
| a48 | 0.050 | 0.48 | 0.45 | 0.028 | 0.010 | 18.0 | 1.00 | 0.00 | 0.060 | | | | | 51.8 |
| a49 | 0.100 | 0.48 | 0.45 | 0.028 | 0.010 | 12.5 | 0.20 | 0.10 | 0.060 | | | | | 117.0 |
| a50 | 0.150 | 0.48 | 0.45 | 0.028 | 0.010 | 16.1 | 1.70 | 0.00 | 0.030 | | | | | 117.7 |
| a51 | 0.075 | 0.35 | 0.60 | 0.028 | 0.010 | 16.7 | 0.00 | 0.00 | 0.035 | | | | 0.08 | 45.1 |
| a52 | 0.300 | 0.48 | 0.45 | 0.028 | 0.003 | 16.5 | 0.50 | 0.00 | 0.032 | | | | | 149.4 |

Note)
Underlines indicate outside scope of invention.

TABLE 3

| | Steel | Dual-phase forming annealing temperature (° C.) | Temper rolling rate (%) | Aging temperature (° C.) |
|---|---|---|---|---|
| Inv. ex. | A1 | 1100 | 30 | — |
| | A2 | 980 | — | 250 |
| | A3 | 1080 | 1 | — |
| | A4 | 850 | — | 300 |
| | A5 | 1050 | 5 | — |
| | A6 | 1080 | — | — |
| | A7 | 1020 | — | — |
| | A8 | 1040 | 10 | — |
| | A9 | 1090 | — | — |
| | A10 | 900 | — | 300 |
| | A11 | 1050 | — | — |
| | A12 | 1100 | 5 | — |
| | A13 | 1040 | 2 | — |
| | A14 | 1020 | — | — |
| | A15 | 1080 | — | — |
| | A16 | 920 | — | 300 |
| | A17 | 1090 | 1 | — |
| | A18 | 1070 | — | 250 |
| | A19 | 950 | 1 | — |
| | A20 | 1080 | — | — |
| | A21 | 1080 | — | — |
| | A22 | 1060 | 2 | — |
| | A23 | 1070 | — | — |
| | A29 | 1080 | 3 | — |
| | A30 | 1050 | 20 | — |
| | A31 | 1090 | — | 250 |

TABLE 4

| | Steel | Dual-phase forming annealing temperature (° C.) | Temper rolling rate (%) | Aging temperature (° C.) |
|---|---|---|---|---|
| Comp. ex. | a32 | 920 | 50 | 300 |
| | a33 | 1050 | — | 250 |
| | a34 | 1080 | — | — |
| | a35 | 1070 | — | — |
| | a36 | 1050 | — | — |
| | a37 | 1060 | 10 | 200 |
| | a38 | 1080 | — | — |
| | a39 | 1090 | — | — |
| | a40 | 900 | — | — |
| | a41 | 1080 | — | 200 |
| | a42 | 1040 | 5 | — |

TABLE 4-continued

| Steel | Dual-phase forming annealing temperature (° C.) | Temper rolling rate (%) | Aging temperature (° C.) |
|---|---|---|---|
| a43 | 1040 | — | 250 |
| a44 | 1040 | 2 | — |
| a45 | 1100 | — | — |
| a46 | 870 | 20 | 250 |
| a47 | 1080 | 10 | 250 |
| a48 | 1080 | — | 250 |
| a49 | 1000 | — | 200 |
| a50 | 1050 | — | 200 |
| a51 | 850 | — | — |
| a52 | 1080 | — | 300 |

The steels A1 to A31 of Table 1 are stainless steels which satisfy the composition prescribed in the present invention, while the steels a32 to a52 of Table 2 are comparative examples. The steel a49 corresponds to SUS410, the steel a50 to SUS429J1, the steel a51 to SUS430, and the steel a52 to SUS431.

The obtained steel sheets were evaluated as follows:

The hardness was measured by the test method of Vicker's hardness prescribed in JIS 22244 and was measured from the surface of the steel sheet.

The amount of ferrite was identified by corrosively etching the structure by the Murakami reagent described in the Stainless Steel Handbook (issued 1976, 4th edition, p. 871), then combining microscopic observation and image analysis.

The corrosion resistance was evaluated by using the pitting potential measurement method of stainless steel prescribed in JIS G0577 and judging samples exhibiting a value the same or higher than SUS430LX steel as "good (+)" and samples exhibiting a lower value as "poor (−)".

The weather resistance was evaluated by testing a test piece which was polished to a mirror surface by a test repeating for six cycles a one-month exposure test outdoors and an abrasion test of plastic prescribed in JIS K7205 and evaluating the degree of deterioration of the mirror surface gloss.

The mirror surface glossiness was measured by the method 5 (GS20°) of the methods of measurement of mirror surface glossiness prescribed in JIS 28741. Samples where, as a result of measurement of the mirror surface glossiness, the drop in gloss was a small one of less than 50 were judged as "good (+)" and samples where a drop in gloss over 50 occurred were judged as "poor (−)".

In the plastic abrasion test, to suppress abrasion and damage of the tester, a 400 HV5 or more material was used for the rotary disk. In the evaluation of the material quality, samples with a hardness of 200 HV or more and free from brittle fracture at the time of shearing were evaluated as "good (+)" and samples with a hardness of 200 HV or less or suffering from brittle fracture at the time of shearing were evaluated as "poor (−)".

The edge cracks of a hot rolled sheet were evaluated by observing the hot rolled coil from the end faces, measuring the number of edge cracks, and ranking sheets with less than 0.25/km as "A", 0.25/km to less than 1.25/km as "B", 1.25/km to less than 2.5/km as "C", and 2.5/km or more as "D".

Tables 5 and 6 show the results of evaluation.

TABLE 5

| | Steel | Hardness HV5 | Am't of ferrite (%) | Corrosion resistance | Weather resistance | Material quality | Edge crack evaluation | Remarks |
|---|---|---|---|---|---|---|---|---|
| Inv. ex. | A1 | 344 | 28 | + | + | + | B | |
| | A2 | 488 | 10 | + | + | + | B | |
| | A3 | 515 | 17 | + | + | + | B | |
| | A4 | 340 | 29 | + | + | + | B | |
| | A5 | 364 | 25 | + | + | + | B | |
| | A6 | 379 | 17 | + | + | + | B | |
| | A7 | 386 | 23 | + | + | + | B | |
| | A8 | 356 | 21 | + | + | + | B | |
| | A9 | 480 | 12 | + | + | + | B | |
| | A10 | 339 | 32 | + | + | + | B | |
| | A11 | 369 | 17 | + | + | + | B | |
| | A12 | 359 | 29 | + | + | + | B | |
| | A13 | 324 | 17 | + | + | + | B | |
| | A14 | 357 | 34 | + | + | + | B | |
| | A15 | 419 | 24 | + | + | + | B | |
| | A16 | 449 | 11 | + | + | + | A | |
| | A17 | 396 | 26 | + | + | + | A | |
| | A18 | 318 | 32 | + | + | + | B | |
| | A19 | 497 | 9 | + | + | + | B | |
| | A20 | 238 | 37 | + | + | + | B | |
| | A21 | 401 | 26 | + | + | + | B | |
| | A22 | 457 | 20 | + | + | + | B | |
| | A23 | 468 | 17 | + | + | + | B | |
| | A29 | 470 | 16 | + | + | + | B | |
| | A30 | 359 | 40 | + | + | + | B | |
| | A31 | 505 | 5 | + | + | + | B | |

TABLE 6

| | Steel | Hardness HV5 | Am't of ferrite (%) | Corrosion resistance | Weather resistance | Material quality | Edge crack evaluation | Remarks |
|---|---|---|---|---|---|---|---|---|
| Comp. ex. | a32 | 160 | 75 | − | − | − | D | |
| | a33 | 644 | 0 | − | − | − | B | |
| | a34 | 484 | 24 | − | − | − | B | |
| | a35 | 236 | 64 | − | − | + | D | Uneven gloss |
| | a36 | 438 | 26 | − | − | + | B | |
| | a37 | 401 | 8 | − | − | + | B | |
| | a38 | 406 | 15 | − | − | + | B | |
| | a39 | 178 | 100 | + | − | − | B | |
| | a40 | 195 | 85 | − | − | − | D | |
| | a41 | 459 | 0 | + | + | − | B | |
| | a42 | 371 | 16 | − | − | + | B | |
| | a43 | 328 | 15 | − | − | + | B | |
| | a44 | 429 | 17 | − | + | + | B | Gas porosity type defects |
| | a45 | 313 | 31 | − | − | − | B | |
| | a46 | 187 | 82 | + | − | − | D | |
| | a47 | 517 | 3 | − | − | + | B | Inclusion type defects increase |
| | a48 | 197 | 75 | − | − | − | D | |
| | a49 | 450 | 0 | − | − | − | B | |
| | a50 | 420 | 0 | − | + | − | B | |

TABLE 6-continued

| Steel | Hardness HV5 | Am't of ferrite (%) | Corrosion resistance | Weather resistance | Material quality | Edge crack evaluation | Remarks |
|---|---|---|---|---|---|---|---|
| a51 | 180 | 100 | – | – | – | D | |
| a52 | 550 | 0 | – | + | – | B | |

Note)
Underlines indicate outside scope of invention.

It was confirmed that by dual-phase forming annealing a cold rolled steel strip of the scope of ingredients prescribed in the present invention, it was possible to obtain a material excellent in corrosion resistance, weather resistance, and material quality.

Furthermore, the steels A16 and A17 with B added had extremely little edge cracks at the width ends of the hot rolled sheets and exhibited excellent end face properties.

In the comparative examples, the steels a33, a34, a39, a40, a42, a44 to a48, and a50 to a52 with contents of Sn of less than 0.05%, the steels a38, a39, and a49 with contents of Cr of less than 15%, the steel a37 with a content of S of over 0.01%, the steel a36 with a P of over 0.04%, and the steel a43 with a B of over 0.0050% were poor in corrosion resistance.

The steels a39 and a46 with a γp of less than 60 were good in corrosion resistance, but deteriorated upon abrasion and were poor in weather resistance.

The steel a32 with a C of less than 0.020 the steel a39 with a Cr of over 18%, an Sn of 0%, and a hardness of less than 200 HV was poor in corrosion resistance, further deteriorated upon abrasion, and was poor in weather resistance.

The steels a33, a41, a49, a50, and a52 with a γp of over 95 or a C of over 0.20% and the steel a45 with a Cu of over 2% became too hard, so the material quality was poor.

The steel a35 had an Mn of over 2%, so uneven gloss occurred at the time of dual-phase forming annealing and the result was poor.

The steel a41 had an Ni of over 2.5%, so the result was unsuitable in terms of costs as well.

The steel a44 had an N of over 0.09%, so gas porosity type defects appeared at the surface and the result was poor.

The steel a47 had an Al of over 0.1%, so inclusion type defects occurred and the result was poor.

Example 2

The various types of stainless steels of the chemical compositions which are shown in Tables 7 and 8 were smelted in a vacuum melting furnace, heated at 1160° C. for 1 hour, then hot rolled to obtain thickness 3.0 mm hot rolled steel strips which were then placed in a 760° C. coiling reproducing furnace and furnace cooled. The hot rolled strips were annealed at 800° C. for 4 hours, then cooled at 25° C./hr down to 350° C., then air-cooled.

Furthermore, after pickling, cold rolling was used to form thickness 0.5 mm cold rolled steel strips. The cold rolled steel strips were processed by dual-phase forming annealing by a continuous annealing furnace and temper rolling under the conditions which are shown in Tables 9 and 10, then part of the strips were aged.

TABLE 7

| | Steel | C | Si | Mn | P | S | Cr | Ni | Sn | N | B | Cu | Mo | Al | γp |
|---|---|---|---|---|---|---|---|---|---|---|---|---|---|---|---|
| Inv. ex. | B1 | 0.020 | 0.50 | 1.50 | 0.027 | 0.003 | 17.3 | 1.00 | 0.10 | 0.0015 | 0.100 | | | | 72.5 |
| | B2 | 0.150 | 0.50 | 0.35 | 0.027 | 0.008 | 17.0 | 1.00 | 0.10 | 0.0015 | 0.030 | | | | 89.6 |
| | B3 | 0.200 | 0.50 | 0.35 | 0.013 | 0.008 | 18.0 | 0.50 | 0.07 | 0.0015 | 0.020 | | | | 83.1 |
| | B4 | 0.080 | 0.10 | 0.35 | 0.027 | 0.008 | 16.5 | 1.00 | 0.10 | 0.0050 | 0.030 | | | | 70.6 |
| | B5 | 0.090 | 1.00 | 0.35 | 0.027 | 0.007 | 15.2 | 0.80 | 0.05 | 0.0015 | 0.030 | | | | 75.1 |
| | B6 | 0.092 | 0.50 | 0.20 | 0.026 | 0.008 | 15.2 | 1.00 | 0.10 | 0.0015 | 0.025 | | | | 82.5 |
| | B7 | 0.102 | 0.54 | 2.00 | 0.027 | 0.006 | 17.3 | 1.00 | 0.08 | 0.0015 | 0.030 | | | | 77.2 |
| | B8 | 0.078 | 0.50 | 0.35 | 0.040 | 0.008 | 17.3 | 2.00 | 0.10 | 0.0010 | 0.030 | | | | 78.9 |
| | B9 | 0.152 | 0.50 | 0.35 | 0.028 | 0.010 | 17.0 | 1.00 | 0.10 | 0.0015 | 0.025 | | | | 88.1 |
| | B10 | 0.080 | 1.00 | 0.20 | 0.027 | 0.008 | 15.0 | 0.50 | 0.06 | 0.0008 | 0.035 | 0.01 | | | 67.6 |
| | B11 | 0.080 | 0.53 | 0.35 | 0.027 | 0.003 | 16.5 | 1.80 | 0.20 | 0.0015 | 0.030 | | | | 83.3 |
| | B12 | 0.068 | 0.50 | 0.35 | 0.027 | 0.005 | 16.8 | 1.00 | 0.13 | 0.0015 | 0.060 | | 0.02 | | 71.1 |
| | B13 | 0.050 | 0.52 | 0.31 | 0.027 | 0.003 | 17.1 | 2.50 | 0.10 | 0.0015 | 0.035 | | | | 82.8 |
| | B14 | 0.102 | 0.50 | 0.35 | 0.027 | 0.003 | 17.3 | 1.00 | 0.05 | 0.0010 | 0.030 | | | | 66.3 |
| | B15 | 0.130 | 0.51 | 0.35 | 0.027 | 0.004 | 17.3 | 1.00 | 0.30 | 0.0015 | 0.030 | | | | 76.2 |
| | B16 | 0.104 | 0.50 | 0.35 | 0.028 | 0.003 | 17.2 | 1.50 | 0.21 | 0.0003 | 0.052 | | | | 89.1 |
| | B17 | 0.117 | 0.48 | 0.56 | 0.027 | 0.003 | 17.3 | 1.00 | 0.10 | 0.0050 | 0.030 | | | | 74.0 |
| | B18 | 0.085 | 0.50 | 0.35 | 0.027 | 0.009 | 17.3 | 1.80 | 0.08 | 0.0015 | 0.010 | | | | 68.0 |
| | B19 | 0.150 | 0.42 | 0.45 | 0.023 | 0.003 | 17.3 | 1.00 | 0.10 | 0.0015 | 0.032 | 0.05 | | 0.01 | 89.2 |
| | B20 | 0.080 | 0.80 | 0.68 | 0.027 | 0.003 | 18.0 | 1.00 | 0.21 | 0.0015 | 0.032 | 2.00 | | | 65.7 |
| | B21 | 0.095 | 0.48 | 0.45 | 0.028 | 0.010 | 17.3 | 1.00 | 0.18 | 0.0012 | 0.060 | | 0.05 | | 76.9 |
| | B22 | 0.150 | 0.48 | 0.45 | 0.028 | 0.003 | 17.3 | 1.70 | 0.11 | 0.0015 | 0.032 | | 2.00 | | 80.1 |
| | B23 | 0.150 | 0.90 | 0.45 | 0.027 | 0.003 | 17.3 | 1.00 | 0.10 | 0.0015 | 0.032 | | | 0.02 | 83.2 |
| | B29 | 0.150 | 0.50 | 0.45 | 0.027 | 0.003 | 17.6 | 1.00 | 0.21 | 0.0015 | 0.032 | | | 0.10 | 83.6 |
| | B30 | 0.102 | 0.41 | 0.44 | 0.030 | 0.006 | 18.0 | 0.59 | 0.17 | 0.0015 | 0.052 | | | | 60.0 |
| | B31 | 0.147 | 0.56 | 1.10 | 0.027 | 0.003 | 16.3 | 0.70 | 0.10 | 0.0040 | 0.032 | | | | 95.0 |

TABLE 8

| | Steel | C | Si | Mn | P | S | Cr | Ni | Sn | N | B | Cu | Mo | Al | γp |
|---|---|---|---|---|---|---|---|---|---|---|---|---|---|---|---|
| Comp. ex. | b32 | 0.010 | 0.50 | 0.35 | 0.027 | 0.003 | 17.3 | 1.25 | 0.00 | 0.0015 | 0.020 | | | | 29.1 |
| | b33 | 0.210 | 0.50 | 0.35 | 0.027 | 0.008 | 17.2 | 0.80 | 0.00 | 0.0015 | 0.030 | | | | 108.6 |
| | b34 | 0.200 | 2.10 | 0.35 | 0.013 | 0.008 | 18.0 | 0.50 | 0.00 | 0.0015 | 0.020 | | | | 65.2 |
| | b35 | 0.050 | 1.00 | 2.10 | 0.027 | 0.008 | 16.5 | 0.08 | 0.10 | 0.0050 | 0.025 | | | | 36.3 |
| | b36 | 0.152 | 2.00 | 0.35 | 0.042 | 0.007 | 15.1 | 0.08 | 0.05 | 0.0015 | 0.030 | | | | 74.2 |
| | b37 | 0.092 | 0.05 | 1.00 | 0.026 | 0.012 | 15.2 | 1.00 | 0.35 | 0.0015 | 0.025 | | | | 91.6 |
| | b38 | 0.102 | 0.54 | 2.00 | 0.027 | 0.006 | 14.8 | 0.07 | 0.08 | 0.0015 | 0.030 | | | | 84.6 |
| | b39 | 0.020 | 0.50 | 0.20 | 0.040 | 0.008 | 18.2 | 0.00 | 0.00 | 0.0010 | 0.030 | | | | −2.1 |
| | b40 | 0.050 | 0.50 | 0.35 | 0.028 | 0.010 | 17.0 | 0.44 | 0.00 | 0.0015 | 0.008 | | | | 25.1 |
| | b41 | 0.100 | 0.51 | 0.33 | 0.027 | 0.008 | 17.4 | 2.60 | 0.06 | 0.0008 | 0.035 | | | | 103.2 |
| | b42 | 0.080 | 0.53 | 0.35 | 0.027 | 0.003 | 16.5 | 1.80 | 0.04 | 0.0015 | 0.030 | | | | 84.4 |
| | b43 | 0.050 | 0.52 | 0.31 | 0.027 | 0.003 | 16.9 | 2.50 | 0.10 | 0.0060 | 0.035 | | | | 85.1 |
| | b44 | 0.057 | 0.50 | 0.35 | 0.027 | 0.003 | 17.3 | 1.00 | 0.00 | 0.0010 | 0.105 | | | | 83.0 |
| | b45 | 0.063 | 0.51 | 0.35 | 0.027 | 0.004 | 17.3 | 1.00 | 0.00 | 0.0015 | 0.030 | 2.10 | | | 69.1 |
| | b46 | 0.060 | 0.50 | 0.35 | 0.028 | 0.003 | 17.1 | 1.50 | 0.00 | 0.0000 | 0.052 | | 2.20 | | 46.8 |
| | b47 | 0.151 | 0.80 | 0.68 | 0.027 | 0.003 | 16.8 | 1.17 | 0.00 | 0.0015 | 0.032 | | | 0.12 | 96.7 |
| | b48 | 0.050 | 0.48 | 0.45 | 0.028 | 0.010 | 18.0 | 1.00 | 0.00 | 0.0012 | 0.060 | | | | 51.8 |
| | b49 | 0.100 | 0.48 | 0.45 | 0.028 | 0.010 | 12.5 | 0.20 | 0.00 | 0.0012 | 0.060 | | | | 117.7 |
| | b50 | 0.150 | 0.48 | 0.45 | 0.028 | 0.010 | 16.1 | 1.70 | 0.00 | 0.0012 | 0.030 | | | | 117.7 |
| | b51 | 0.075 | 0.35 | 0.60 | 0.028 | 0.010 | 16.7 | 0.00 | 0.00 | 0.0012 | 0.035 | | | 0.08 | 45.1 |
| | b52 | 0.300 | 0.48 | 0.45 | 0.028 | 0.003 | 16.5 | 0.50 | 0.00 | 0.0015 | 0.032 | | | | 149.4 |
| | b32 | 0.010 | 0.50 | 0.35 | 0.027 | 0.003 | 17.3 | 1.25 | 0.00 | 0.0015 | 0.020 | | | | 29.1 |
| | b33 | 0.210 | 0.50 | 0.35 | 0.027 | 0.008 | 17.2 | 0.80 | 0.00 | 0.0015 | 0.030 | | | | 108.6 |
| | b34 | 0.200 | 2.10 | 0.35 | 0.013 | 0.008 | 18.0 | 0.50 | 0.00 | 0.0015 | 0.020 | | | | 65.2 |
| | b35 | 0.050 | 1.00 | 2.10 | 0.027 | 0.008 | 16.5 | 0.08 | 0.10 | 0.0050 | 0.025 | | | | 36.3 |
| | b36 | 0.152 | 2.00 | 0.35 | 0.042 | 0.007 | 15.1 | 0.08 | 0.05 | 0.0015 | 0.030 | | | | 74.2 |

TABLE 9

| | No. | Dual-phase forming annealing temperature (° C.) | Temper rolling rate (%) | Aging temperature (° C.) |
|---|---|---|---|---|
| Inv. ex. | B1 | 1100 | 30 | — |
| | B2 | 980 | — | 250 |
| | B3 | 1080 | 1 | — |
| | B4 | 850 | — | 300 |
| | B5 | 1050 | 5 | — |
| | B6 | 1080 | — | — |
| | B7 | 1020 | — | — |
| | B8 | 1040 | 10 | — |
| | B9 | 1090 | — | — |
| | B10 | 900 | — | 300 |
| | B11 | 1050 | — | — |
| | B12 | 1100 | 5 | — |
| | B13 | 1040 | 2 | — |
| | B14 | 1020 | — | — |
| | B15 | 1080 | — | — |
| | B16 | 920 | — | 300 |
| | B17 | 1090 | 1 | — |
| | B18 | 1070 | — | 250 |
| | B19 | 950 | 1 | — |
| | B20 | 1080 | — | — |
| | B21 | 1080 | — | — |
| | B22 | 1060 | 2 | — |
| | B23 | 1070 | — | — |
| | B29 | 1080 | 3 | — |
| | B30 | 1050 | 20 | — |
| | B31 | 1090 | | 250 |

TABLE 10

| | Steel | Dual-phase forming annealing temperature (° C.) | Temper rolling rate (%) | Aging temperature (° C.) |
|---|---|---|---|---|
| Comp. ex. | b32 | 920 | 50 | 300 |
| | b33 | 1050 | — | 250 |
| | b34 | 1080 | — | — |
| | b35 | 1070 | — | — |
| | b36 | 1050 | — | — |

TABLE 10-continued

| | Steel | Dual-phase forming annealing temperature (° C.) | Temper rolling rate (%) | Aging temperature (° C.) |
|---|---|---|---|---|
| | b37 | 1060 | 10 | 200 |
| | b38 | 1080 | — | — |
| | b39 | 1090 | — | — |
| | b40 | 900 | — | — |
| | b41 | 1080 | — | 200 |
| | b42 | 1040 | 5 | — |
| | b43 | 1040 | — | 250 |
| | b44 | 1040 | 2 | — |
| | b45 | 1100 | — | — |
| | b46 | 870 | 20 | 250 |
| | b47 | 1080 | 10 | 250 |
| | b48 | 1080 | — | 250 |
| | b49 | 1000 | — | 200 |
| | b50 | 1050 | — | 200 |
| | b51 | 850 | — | — |
| | b52 | 1080 | — | 300 |

The steels B1 to B31 of Table 7 are stainless steels which satisfy the composition which is prescribed in the present invention, while the steels b32 to b52 of Table 8 are comparative examples. The steel b49 corresponds to SUS410, the steel b50 to SUS429J1, the steel b51 to SUS430, and the steel b52 to SUS431.

The obtained steel sheets were evaluated in the same way as in Example 1. Tables 11 and 12 show the results.

TABLE 11

| | Steel | Hardness HV5 | Am't of ferrite (%) | Corrosion resistance | Weather resistance | Material quality | Edge crack score | Remarks |
|---|---|---|---|---|---|---|---|---|
| Inv. ex. | B1 | 344 | 28 | + | + | + | A | |
| | B2 | 488 | 10 | + | + | + | A | |
| | B3 | 515 | 17 | + | + | + | A | |
| | B4 | 340 | 29 | + | + | + | A | |
| | B5 | 364 | 25 | + | + | + | A | |
| | B6 | 379 | 17 | + | + | + | A | |
| | B7 | 386 | 23 | + | + | + | A | |
| | B8 | 356 | 21 | + | + | + | A | |
| | B9 | 480 | 12 | + | + | + | A | |
| | B10 | 339 | 32 | + | + | + | A | |
| | B11 | 369 | 17 | + | + | + | A | |
| | B12 | 359 | 29 | + | + | + | A | |
| | B13 | 324 | 17 | + | + | + | A | |
| | B14 | 357 | 34 | + | + | + | A | |
| | B15 | 419 | 24 | + | + | + | A | |
| | B16 | 449 | 11 | + | + | + | A | |
| | B17 | 396 | 26 | + | + | + | A | |
| | B18 | 318 | 32 | + | + | + | A | |
| | B19 | 489 | 11 | + | + | + | A | |
| | B20 | 331 | 34 | + | + | + | A | |
| | B21 | 409 | 23 | + | + | + | A | |
| | B22 | 457 | 20 | + | + | + | A | |
| | B23 | 468 | 17 | + | + | + | A | |
| | B29 | 470 | 16 | + | + | + | A | |
| | B30 | 359 | 40 | + | + | + | A | |
| | B31 | 505 | 5 | + | + | + | A | |

TABLE 12

| | Steel | Hardness HV5 | Am't of ferrite (%) | Corrosion resistance | Weather resistance | Material quality | Edge crack score | Remarks |
|---|---|---|---|---|---|---|---|---|
| Comp. ex. | b32 | 160 | 75 | − | − | + | C | |
| | b33 | 644 | 0 | − | − | − | A | |
| | b34 | 442 | 35 | − | − | − | A | |
| | b35 | 236 | 64 | − | − | + | C | Uneven gloss |
| | b36 | 438 | 26 | − | − | + | A | |
| | b37 | 401 | 8 | − | − | + | A | |
| | b38 | 406 | 15 | − | − | + | A | |
| | b39 | 178 | 100 | + | − | + | A | |
| | b40 | 195 | 85 | − | − | − | C | |
| | b41 | 459 | 0 | + | + | − | A | |
| | b42 | 371 | 16 | − | − | + | A | |
| | b43 | 328 | 15 | − | − | + | A | |
| | b44 | 429 | 17 | − | + | + | A | Gas porosity-type defects |
| | b45 | 313 | 31 | − | − | − | A | |
| | b46 | 187 | 82 | + | − | + | C | |
| | b47 | 517 | 3 | − | − | + | A | Increase in inclusion type defects |
| | b48 | 197 | 75 | + | − | + | C | |
| | b49 | 450 | 0 | − | − | − | A | |
| | b50 | 420 | 0 | + | + | − | A | |
| | b51 | 180 | 100 | − | − | + | C | |
| | b52 | 550 | 0 | + | + | − | A | |

Note)
Underlines indicate outside scope of invention.

It was confirmed that by dual-phase forming annealing a cold rolled steel strip of the scope of ingredients prescribed in the present invention, it was possible to obtain a material excellent in corrosion resistance, weather resistance, and material quality.

Furthermore, there were extremely little edge cracks at the width ends of the hot rolled sheets and excellent end face properties were exhibited.

In the comparative examples, the steels b32 to b34, b39, b40, b42, and b44 to b52 with amounts of addition of Sn of less than 0.05%, the steels b38 and b49 with a Cr of less than 15%, the steel B37 with an S of over 0.01, the steel b36 with a P of over 0.04%, and the steel b43 with a B of over 0.0050% were poor in corrosion resistance.

The steels b39 and b46 with a γp of less than 60 were good in corrosion resistance, but deteriorated due to abrasion and were poor in weather resistance.

The steel b32 with a C of less than 0.020% and an Sn of 0% and the steel b39 with a Cr of over 18%, an Sn of 0%, and a hardness of less than 200 HV were poor in corrosion resistance, deteriorated due to abrasion, and were poor in weather resistance.

The steels b33, b41, b49, b50, and b52 with a γp of over 95 or a C of over 0.20% and the steel b45 with a Cu of over 2% were too hard and were poor in material quality.

The steel b35 had an Mn of over 2% and suffered from uneven gloss at the time of dual-phase forming annealing, so the result was poor.

The steel b41 had an Ni of over 2.5%, so was also unsuitable in terms of cost.

The steel b44 had an N of over 0.09%, gas porosity type defects appeared at the surface, and the result was poor.

The steel b47 had an Al of over 0.1%, so defects occurred due to inclusions and the result was poor.

INDUSTRIAL APPLICABILITY

According to the present invention, it is possible to inexpensively provide high strength, dual-phase structure stainless steel which is improved in corrosion resistance of particularly the martensite phase, achieves a corrosion resistance corresponding to 18 to 19Cr steel based on 17Cr without changing the phase balance, withstands severe outdoor corrosion and abrasive environments, and does not drop in mirror surface gloss over a long term and possible to apply this as the material for various parts such as reflectors of solar light and home lightening equipment, mirrors, machinery, and electrical and electronic equipment, so the applicability in industry is large.

The invention claimed is:

1. A dual-phase stainless steel sheet comprising, by mass %,

C: 0.02 to 0.20%,
Si: 0.10 to 1.0%,
Mn: 0.20 to 2.0%,
P: 0.040% or less,
S: 0.010% or less,
Cr: 15.0 to 18.0%,
Ni: 0.5 to 2.5%,
Sn: 0.05 to 0.30%,
N: 0.010 to 0.10%, and
a balance of Fe and unavoidable impurities,
wherein the dual-phase stainless steel sheet has a ferrite and martensite dual-phase microstructure, and a Vicker's hardness of 200HV or more, and
wherein a γp defined by the following formula (a) is in the range of 60 to 95:

$$\gamma p=420C+470N+23Ni+7Mn+9Cu-11.5Cr-11.5Si-12Mo-7Sn-49Ti-47Nb-52Al+189 \quad (a).$$

2. The dual-phase stainless steel sheet as set forth in claim 1 further comprising, by mass %, one or more of
B: 0.0003 to 0.0050%,
Cu: 0.30 to 2.0%,
Mo: 0.30 to 2.0%, and
Al: 0.01 to 0.1%.

3. A method of production of a dual-phase stainless steel sheet, the method comprising:

heating a cold rolled stainless steel sheet comprising, by mass %, C: 0.02 to 0.20%, Si: 0.10 to 1.0%, Mn: 0.20 to 2.0%, P: 0.040% or less, S: 0.010% or less, Cr: 15.0 to 18.0%, Ni: 0.5 to 2.5%, Sn: 0.05 to 0.30%, N: 0.010 to 0.10%, and a balance of Fe and unavoidable impurities, to a ferrite and austenite dual-phase region of 850 to 1100° C.; and cooling the stainless steel sheet for dual-phase annealing to thereby cause the austenite phase to transform to martensite; wherein the stainless steel sheet has a ferrite and martensite dual-phase microstructure at room temperature.

4. The method of production as set forth in claim 3, wherein the cooling in said dual-phase annealing comprises a cooling speed of 20° C./s or more down to a temperature of 550° C. or less.

5. The method of production as set forth in claim 3, further comprising performing temper rolling and/or aging after said dual-phase annealing.

6. The method of production as set forth in claim 3, wherein the cold rolled stainless steel sheet further comprises, by mass %, one or more of B: 0.0003 to 0.0050%, Cu: 0.30 to 2.0%, Mo: 0.30 to 2.0%, and Al: 0.01 to 0.1%.

7. A dual-phase stainless steel strip comprising, by mass %,

C: 0.02 to 0.20%,
Si: 0.10 to 1.0%,
Mn: 0.20 to 2.0%,
P: 0.040% or less,
S: 0.010% or less,
Cr: 15.0 to 18.0%,
Ni: 0.5 to 2.5%,
Sn: 0.05 to 0.30%,
N: 0.010 to 0.10%, and
a balance of Fe and unavoidable impurities,
wherein the dual-phase stainless steel strip has a ferrite and martensite dual-phase microstructure, and a Vicker's hardness of 200HV or more, and
wherein a γp defined by the following formula (a) is in the range of 60 to 95:

$$\gamma p=420C+470N+23Ni+7Mn+9Cu-11.5Cr-11.5Si-12Mo-7Sn-49Ti-47Nb-52Al+189 \quad (a).$$

8. The dual-phase stainless steel strip as set forth in claim 7 further comprising, by mass %, one or more of
B: 0.0003 to 0.0050%,
Cu: 0.30 to 2.0%,
Mo: 0.30 to 2.0%, and
Al: 0.01 to 0.1%.

9. A method of production of a dual-phase stainless steel strip, the method comprising:

heating a cold rolled stainless steel strip comprising, by mass %, C: 0.02 to 0.20%, Si: 0.10 to 1.0%, Mn: 0.20 to 2.0%, P: 0.040% or less, S: 0.010% or less, Cr: 15.0 to 18.0%, Ni: 0.5 to 2.5%, Sn: 0.05 to 0.30%, N: 0.010 to 0.10%, and a balance of Fe and unavoidable impurities, to a ferrite and austenite dual-phase region of 850 to 1100° C.; and cooling the stainless steel strip for dual-phase annealing to thereby cause the austenite phase to transform to martensite; wherein the stainless steel strip has a ferrite and martensite dual-phase microstructure at room temperature.

10. The method of production as set forth in claim 9, wherein the cooling in said dual-phase annealing comprises a cooling speed of 20° C./s or more down to a temperature of 550° C. or less.

11. The method of production as set forth in claim 9, further comprising performing temper rolling and/or aging after said dual-phase annealing.

12. The method of production as set forth in claim 9, wherein the cold rolled stainless steel strip further comprises, by mass %, one or more of B: 0.0003 to 0.0050%, Cu: 0.30 to 2.0%, Mo: 0.30 to 2.0%, and Al: 0.01 to 0.1%.

* * * * *